US008676097B2

(12) United States Patent
Hirota et al.

(10) Patent No.: US 8,676,097 B2
(45) Date of Patent: Mar. 18, 2014

(54) DEVELOPING DEVICE, ASSEMBLY, AND IMAGE FORMING APPARATUS WITH A BIASING MEMBER

(71) Applicant: Fuji Xerox Co., Ltd., Tokyo (JP)

(72) Inventors: Makoto Hirota, Tokyo (JP); Jun Abe, Tokyo (JP); Shota Oba, Tokyo (JP); Takashi Ochi, Tokyo (JP); Miho Ikeda, Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/857,600

(22) Filed: Apr. 5, 2013

(65) Prior Publication Data

US 2013/0302068 A1 Nov. 14, 2013

Related U.S. Application Data

(63) Continuation of application No. 12/862,274, filed on Aug. 24, 2010, now abandoned.

(30) Foreign Application Priority Data

Mar. 16, 2010 (JP) ..... 2010-059738

(51) Int. Cl.
*G03G 15/09* (2006.01)

(52) U.S. Cl.
USPC ..... 399/269; 399/272; 399/274

(58) Field of Classification Search
USPC ..... 399/269, 272, 274
See application file for complete search history.

(56) References Cited

U.S. PATENT DOCUMENTS

| | | | | |
|---|---|---|---|---|
| 4,063,533 | A * | 12/1977 | White | 399/269 |
| 4,470,689 | A * | 9/1984 | Nomura et al. | |
| 5,516,982 | A * | 5/1996 | Takeuchi et al. | 399/274 |
| 6,330,414 | B1 | 12/2001 | Takuma et al. | |
| 7,466,946 | B2 | 12/2008 | Tsujita et al. | |
| 2006/0216069 | A1 | 9/2006 | Tsujita et al. | |
| 2011/0222918 | A1 * | 9/2011 | Ikeda et al. | 399/269 |

FOREIGN PATENT DOCUMENTS

| | | |
|---|---|---|
| JP | A-2003-143001 | 5/2003 |
| JP | A-2006-47840 | 2/2006 |
| JP | A-2006-146286 | 6/2006 |

(Continued)

OTHER PUBLICATIONS

Oct. 5, 2012 Office Action issued in U.S. Appl. No. 12/862,274.

(Continued)

*Primary Examiner* — David Gray
*Assistant Examiner* — Laura Roth
(74) *Attorney, Agent, or Firm* — Oliff PLC

(57) ABSTRACT

A developing device includes a first developing member rotating such that a moving direction of a portion opposing the image carrier is opposite a moving direction of the image carrier. A second developing member is provided on a downstream side of the first developing member in a rotating direction of the image carrier rotating such that a moving direction of a portion opposing the image carrier is the same as the moving direction of the image carries. A distributing member is supported movably relative to a proximal portion where the first developing member is closest to the second developing member so as to distribute developer to the first and second developing members by contact with the developer, and a biasing member biases the distributing member upstream in the rotating direction of the first developing member.

6 Claims, 7 Drawing Sheets

(56) References Cited

FOREIGN PATENT DOCUMENTS

| | | |
|---|---|---|
| JP | A-2007-047640 | 2/2007 |
| JP | A-2007-164066 | 6/2007 |
| JP | A-2008-145798 | 6/2008 |

OTHER PUBLICATIONS

Sep. 27, 2013 Office Action issued in Chinese Patent Application No. 201010503186.4 (with translation).

* cited by examiner

DEVELOPING DEVICE, ASSEMBLY, AND IMAGE FORMING APPARATUS WITH A BIASING MEMBER

This is a Continuation of application Ser. No. 12/862,274 filed Aug. 24, 2010. The disclosure of the prior application is hereby incorporated by reference herein in its entirety.

CROSS-REFERENCE TO RELATED APPLICATIONS

This application is based on and claims priority under 35 USC 119 from Japanese Patent Application No. 2010-059738 filed Mar. 16, 2010.

BACKGROUND

Technical Field

The present invention relates to a developing device, an assembly, and an image forming apparatus.

SUMMARY

According to an aspect of the invention, there is provided a developing device including a first developing member that opposes a surface of a rotating image carrier and rotates in a manner such that a moving direction of a portion opposing the image carrier is opposite a moving direction of the image carrier; a second developing member that is provided on a downstream side of the first developing member in a rotating direction of the image carrier, opposes the surface of the image carrier, and rotates in a manner such that a moving direction of a portion opposing the image carrier is the same as the moving direction of the image carrier; a distributing member that is supported movably relative to a proximal portion between the first developing member and the second developing member where the first developing member is closest to the second developing member, the distributing member being provided on a downstream side of the proximal portion in a rotating direction of the first developing member, and distributing, to the first developing member and the second distributing member, developer lying between a surface of the first developing member and a surface of the second developing member by contact with the developer; and a biasing member that biases the distributing member upstream in the rotating direction of the first developing member.

BRIEF DESCRIPTION OF THE DRAWINGS

Exemplary embodiments of the present invention will be described in detail based on the following figures, wherein.

DETAILED DESCRIPTION

Figure 1:
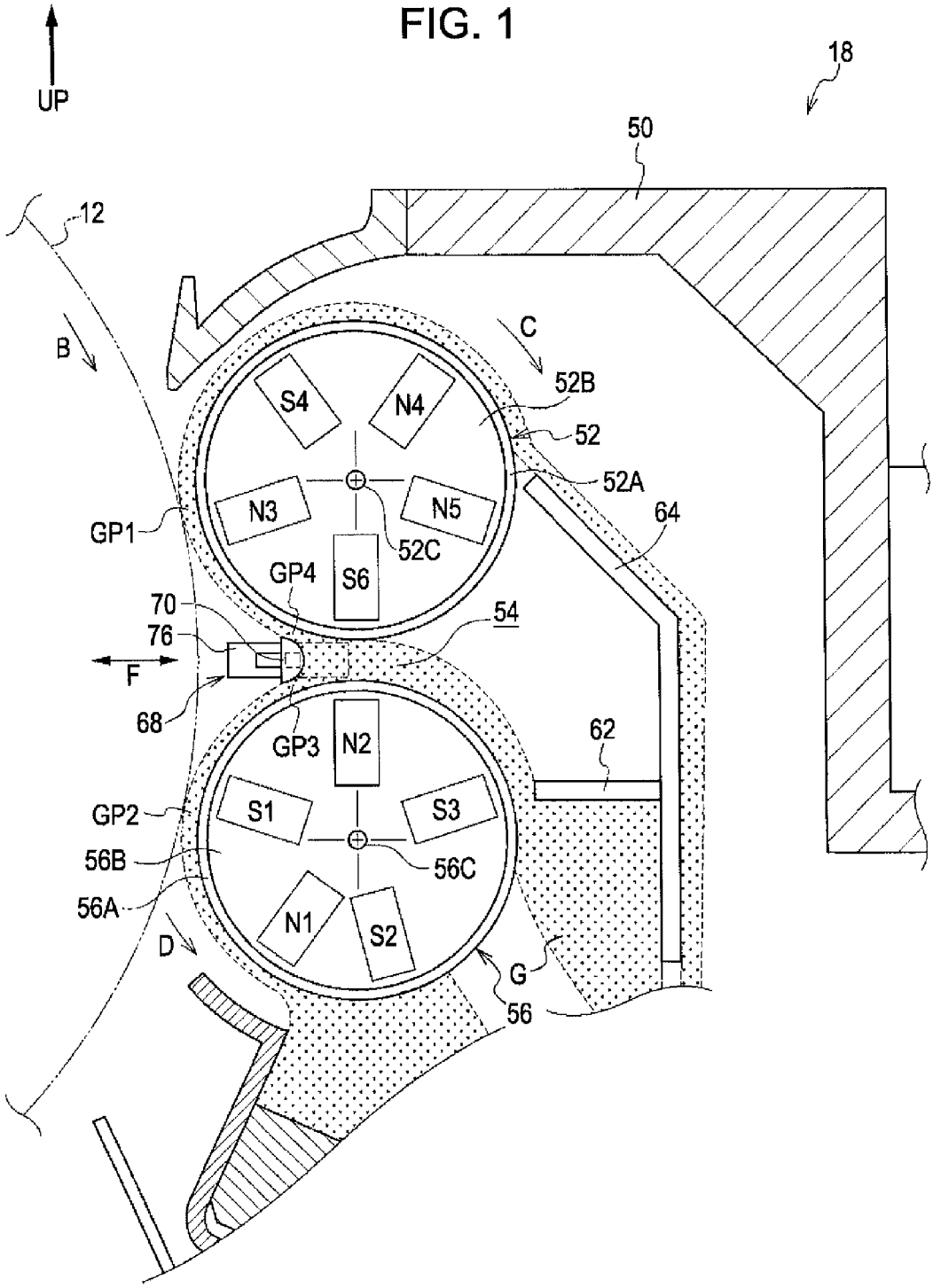
FIG. 1 is a side view illustrating developing rollers, a distributing member, etc. in a developing device according to a first exemplary embodiment of the present invention.

Examples of a developing device, an assembly, and an image forming apparatus according to a first exemplary embodiment of the present invention will be described with reference to FIGS. 1 to 5. In the drawings, the arrow "UP" indicates an upper side in the vertical direction.

Overall Configuration

Figure 5:
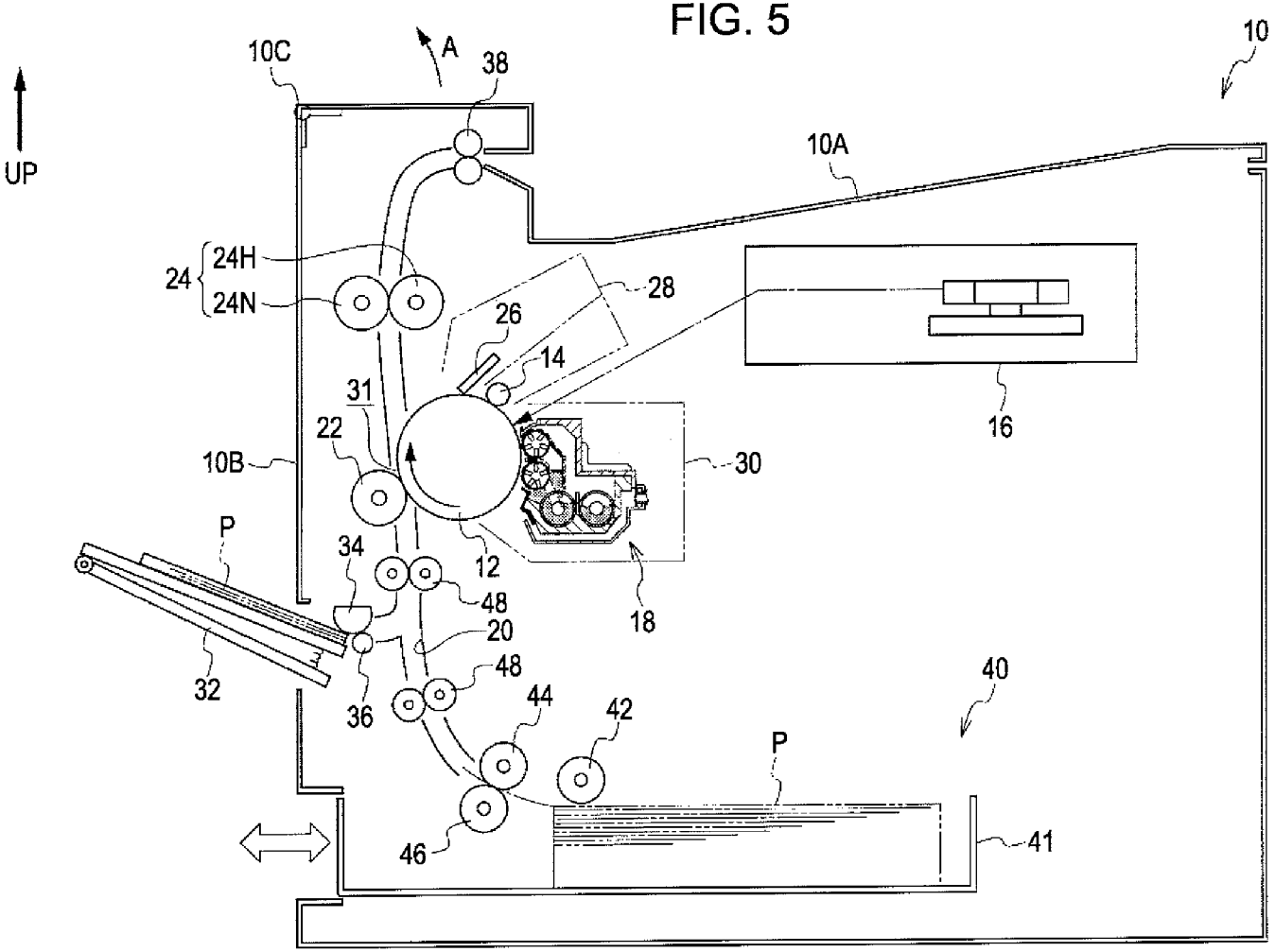
FIG. 5 is a schematic structural view illustrating an image forming apparatus, an assembly, etc. according to the first exemplary embodiment of the present invention.

As illustrated in FIG. 5, an image forming apparatus 10 includes an image carrier 12, a charging device 14, an exposure device 16, a developing device 18, a transfer roller 22, a fixing device 24, and a cleaning device 26. The charging device 14 uniformly charges a surface of the image carrier 12, and the exposure device 16 irradiates the surface of the image carrier 12 with laser light on the basis of image data so as to form an electrostatic latent image on the surface of the image carrier 12. The developing device 18 visualizes the electrostatic latent image as a toner image by selectively transferring toner onto the electrostatic latent image. The transfer roller 22 transfers the toner image on the surface of the image carrier 12 onto a sheet material P supplied as a recording material along a transport path 20. The fixing device 24 fixes the toner image on the sheet material P by heat and pressure. The cleaning device 26 cleans residual toner off the image carrier 12 after the toner image is transferred. The developing device 18 will be described in detail below.

The image forming apparatus 10 is covered with a body side face cover 10B and a top plate 10A. The top plate 10A is turnably connected to the body side face cover 10B by a shaft 10C provided at an upper corner of the body side face cover 10B. By turning the top plate 10A on the shaft 10C in a direction of arrow A, the interior of the image forming apparatus 10 is opened.

The charging device 14 and the cleaning device 26 constitute one charging unit 28, and the developing device 18 and the image carrier 12 constitute an exchangeable cartridge 30 serving as an assembly. When the top plate 10A of the image forming apparatus 10 is opened, the charging unit 28 and the exchangeable cartridge 30 are detachable from a body frame (not shown) provided in the image forming apparatus 10.

A manual feeder 32 is provided on a side of the image forming apparatus 10. The manual feeder 32 allows sheet materials P to be manually supplied to an image forming unit 31 formed by the image carrier 12 and the transfer roller 22. The manual feeder 32 has a feeding roller 34 shaped like a half moon. A separation roller 36 is provided on a side of the sheet material P opposite the feeding roller 34.

The separation roller 36 is rotatably supported by support members (not shown) provided at both ends thereof, and is biased toward the feeding roller 34 by the biasing force of coil springs provided in the support members. With this structure, when the feeding roller 34 rotates, sheet materials P placed on the manual feeder 32 are fed one by one to the image forming unit 31 by the feeding roller 34 and the separation roller 36.

A paper feeding device 40 for feeding sheet materials P one by one is provided on an inner lower side of the image forming apparatus 10. The paper feeding device 40 includes a paper feeding member 41 on which plural sheet materials P are stacked. The sheet materials P stacked on the paper feeding member 41 are sequentially picked up by a pickup roller 42, and are transported one by one by a rotating feeding roller 44 and a separation roller 46 provided in the paper feeding member 41.

Plural transport rollers 48 are provided along the transport path 20 for the sheet materials P so that each of the sheet materials P is transported to a downstream side in the transport direction of the sheet materials P (hereinafter simply referred to as a downstream side) along the transport path 20.

The above-described fixing device 24 is provided downstream of the image forming unit 31. The fixing device 24 includes a heating roller 24H and a pressure roller 24N. While the sheet material P passes between the heating roller 24H and the pressure roller 24N, the toner image is fixed onto the sheet material P.

On the downstream side of the fixing device 24, output rollers 38 are provided to output the sheet material P onto an upper surface of the top plate 10A after the toner image has been fixed on the sheet material P.

In the image forming apparatus 10 having the above-described configuration, image formation is performed as follows.

First, voltage is applied to the charging device 14, and the charging device 14 uniformly and negatively charges the surface of the image carrier 12 at a predetermined potential. Then, the exposure device 16 exposes the charged surface of the image carrier 12 on the basis of image data read by a scanner (not shown) or externally input data, thereby forming an electrostatic latent image on the surface of the image carrier 12.

That is, by turning on and off the application of laser light from the exposure device 16 on the basis of image data supplied from a control device (not shown), an electrostatic latent image corresponding to the image data is formed on the image carrier 12. Further, the electrostatic latent image is visualized as a toner image by the developing device 18 having a developing member to which voltage is applied.

Then, sheet materials P picked up from the paper feeding member 41 by the pickup roller 42 are delivered one by one to the transport rollers 48 by the feeding roller 44 and the separation roller 46, and are fed into the transport path 20. A sheet material P fed into the transport path 20 passes through a transfer unit 31 provided between the transfer roller 22 and the image carrier 12 that holds the toner image, where the toner image is transferred onto the sheet material P. The transferred toner image is fixed on the sheet material P by passing between the heating roller 24H and the pressure roller 24N provided in the fixing device 24, and is then output onto the upper surface of the top plate 10A by the output rollers 38.

Structure of Relevant Part

A description will now be given of the structure of the developing device 18.

Figure 2:
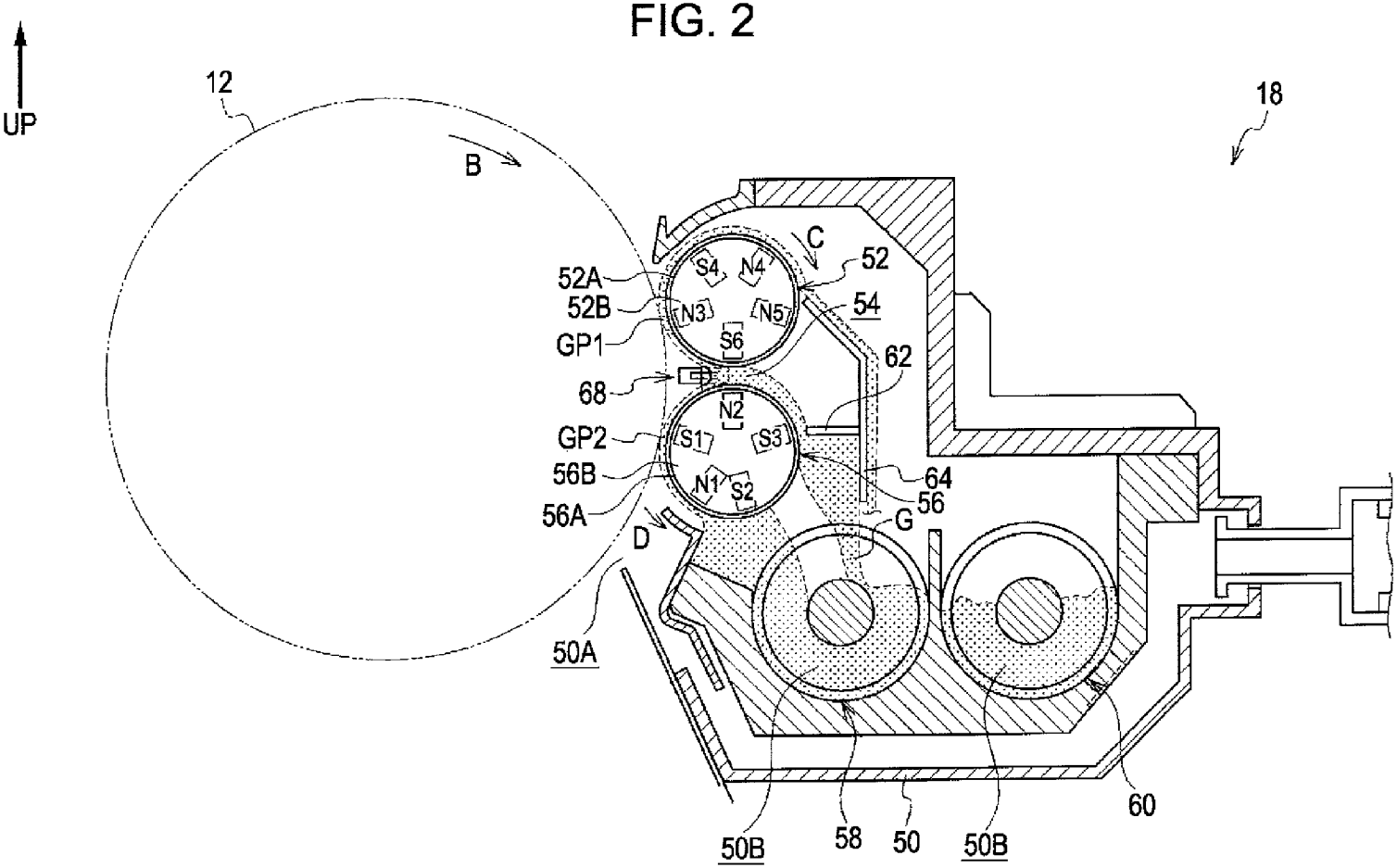
FIG. 2 is a side view of the developing device of the first exemplary embodiment.

As illustrated in FIG. 2, the developing device 18 includes a housing 50 having an opening 50A at a position opposing the image carrier 12. In the housing 50, a first developing roller 52 serving as an example of a first developing member is stored. The first developing roller 52 opposes the surface (outer peripheral surface) of the image carrier 12, and holds developer G on a surface (outer peripheral surface) thereof. The first developing roller 52 rotates in the same direction as a rotating direction of the image carrier 12 shown by arrow B. The moving direction of the first developing roller 52 at a position GP1 opposing the image carrier 12 is opposite (direction of arrow C) to the moving direction of the image carrier 12.

A second developing roller 56 serving as an example of a second developing member is also stored in the housing 50. The second developing roller 56 opposes the surface of the image carrier 12 below the first developing roller 52, and holds the developer G on a surface (outer peripheral surface) thereof. The second developing roller 56 rotates in a direction opposite the rotating direction of the image carrier 12, and the moving direction of the second developing roller 56 at a position GP2 opposing the image carrier 12 is the same (direction of arrow D) as the moving direction of the image carrier 12.

In a reservoir 50B provided in an inner lower part of the housing 50 to store the developer G, a first agitation and transport auger 58 and a second agitation and transport auger 60 are juxtaposed in the horizontal direction, and transport the developer G to the second developing roller 56.

The first agitation and transport auger 58 and the second agitation and transport auger 60 are juxtaposed to circulate and transport the developer G on a lower side (a lower right side of the figure) of the second developing roller 56. When the first agitation and transport auger 58 and the second agitation and transport auger 60 rotate, the developer G is transported in the rotation axis direction of the second developing roller 56 while being agitated, and is then supplied to the second developing roller 56. The developer G used in the developing device 18 is formed by resin toner and magnetic carrier particles.

The first developing roller 52 is located above the second developing roller 56, and includes a first developing sleeve 52A shaped like a cylinder and a first magnet roller 52B shaped like a column. The first developing sleeve 52A opposes the surface of the image carrier 12 in a manner such that the rotation axis direction thereof coincides with the rotation axis direction of the image carrier 12. The moving direction of the first developing sleeve 52A at the position GP1 opposing the image carrier 12 is opposite the moving direction of the image carrier 12. The first magnet roller 52B is located in the first developing sleeve 52A, and forms a magnetic field, which is distributed around the first magnet roller 52B, outside the first developing sleeve 52A. With this structure, the first developing roller 52 develops a latent image on the image carrier 12 with the developer G at the position GP1 opposing the image carrier 12.

In contrast, the second developing roller 56 includes a second developing sleeve 56A shaped like a cylinder and a second magnet roller 56B shaped like a column. The second developing sleeve 56A opposes the surface of the image carrier 12 on the downstream side of the first developing roller 52 in the rotating direction of the image carrier 12 in a manner such that the rotation axis direction thereof coincides with the rotation axis direction of the image carrier 12. The moving direction of the second developing sleeve 56A at the position GP2 opposing the image carrier 12 is the same (direction of arrow D) as the moving direction of the image carrier 12. The second magnet roller 56B is located in the second developing sleeve 56A, and forms a magnetic field, which is distributed around the first magnet roller 56B, outside the second developing sleeve 56A. With this structure, the second developing roller 56 develops a latent image on the image carrier 12 with the developer G at the GP2 opposing the image carrier 12.

Further, the first developing roller 52 and the second developing roller 56 oppose each other to form a gap between the outer periphery of the first developing sleeve 52A and the outer periphery of the second developing sleeve 56A. A proximal portion 54 is provided between the first developing sleeve 52A and the second developing sleeve 56A (a portion where the gap therebetween is the smallest).

On an upstream side of the proximal portion 54 in the rotating direction of the second developing roller 56, a layer forming member 62 opposes the surface of the second developing roller 56, and serves to regulate the height of a layer of the developer G held on the second developing roller 56. The layer forming member 62 is formed by a plate having a rectangular cross section in the normal direction of the outer periphery of the second developing roller 56. One end face of the rectangular cross section opposes the surface of the second developing roller 56, and the other end face is fixed to a guide plate 64 provided in the housing 50.

The guide plate 64 opposes the first developing roller 52 at one end, and extends downward at the other end toward the first agitation and transport auger 58. Further, the guide plate 64 has a structure such as to force the developer G, which falls off the first developing roller 52, down into the reservoir 50B. In other words, the developer G falling off the first developing roller 52 directly falls into the reservoir 50B without adhering to the second developing roller 56.

As illustrated in FIG. 1, in the second magnet roller 56B, five permanent magnets having S- or N-poles on surface sides are radially arranged in the circumferential direction of the second developing sleeve 56A. A pole S1 serving as a developing pole is located at a position opposing the image carrier 12. Next to the developing pole S1, a pole N1 for transport, a pole S2 for pickoff of the developer, a pole S3 for pickup of the developer, and a pole N2 for transport are arranged in that order in the rotating direction D of the second developing sleeve 56A.

In contrast, in the first magnet roller 52B, five permanent magnets having S- or N-poles on surface sides are also radially arranged in the circumferential direction of the first developing sleeve 52A. A pole N3 serving as a developing pole is located at a position opposing the image carrier 12. Next to the developing pole N3, a pole S4 for transport, a pole N4 for pickoff, a pole N5 having the same polarity as that of the pole N4, and a pole S6 opposing the pole N2 of the second magnet roller 563 are arranged in that order in the rotating direction C of the first developing sleeve 52A.

A distributing member 68 for distributing the developer G to the first developing roller 52 and the second developing roller 56 is provided on a downstream side of the proximal portion 54 in the rotating direction of the first developing roller 52. The distributing member 68 extends in the longitudinal direction of the first developing roller 52 and the second developing roller 56.

Figure 3:
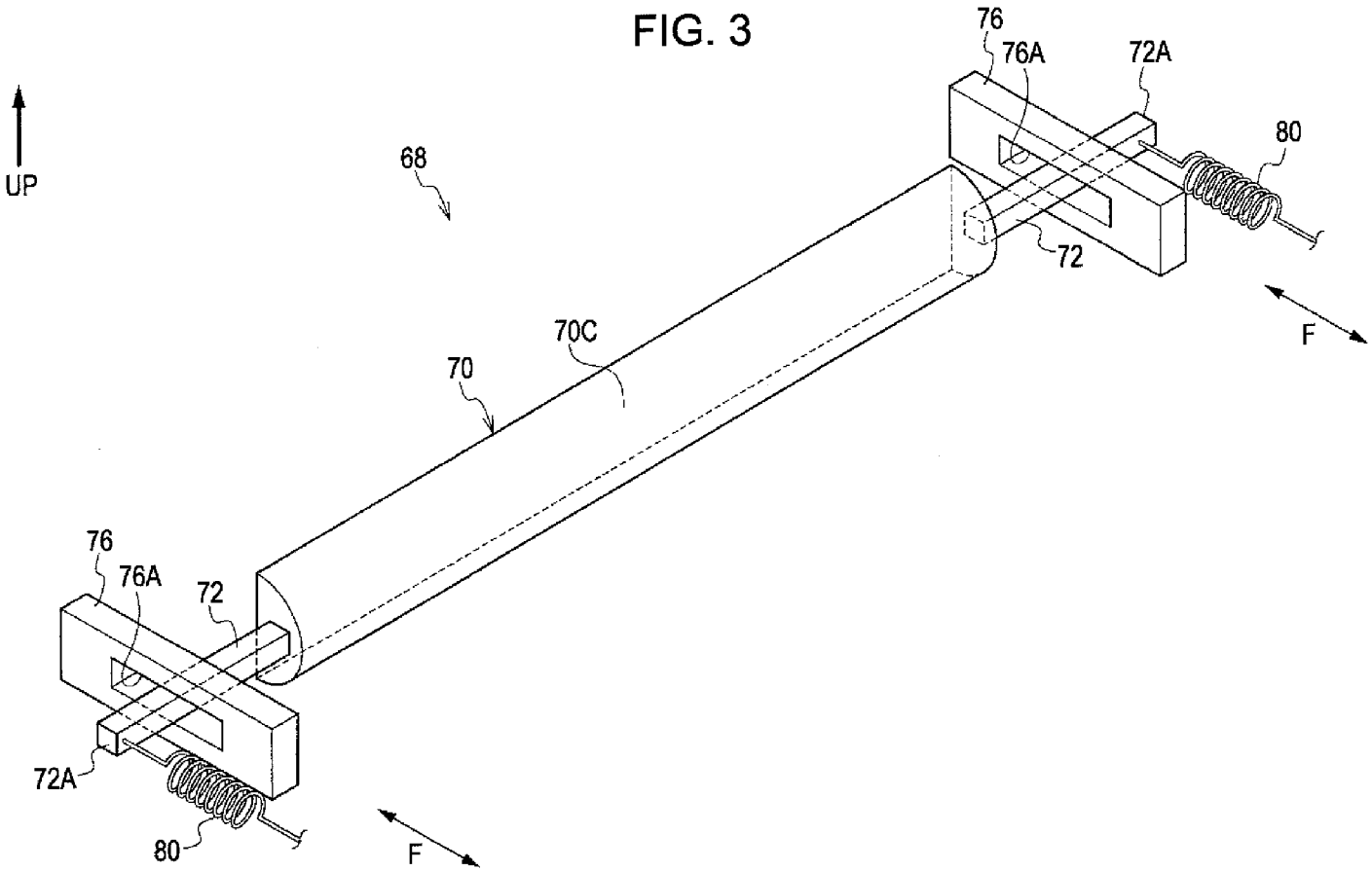
FIG. 3 is a perspective view of the distributing member and its surroundings used in the developing device of the first exemplary embodiment.
Figure 4A:
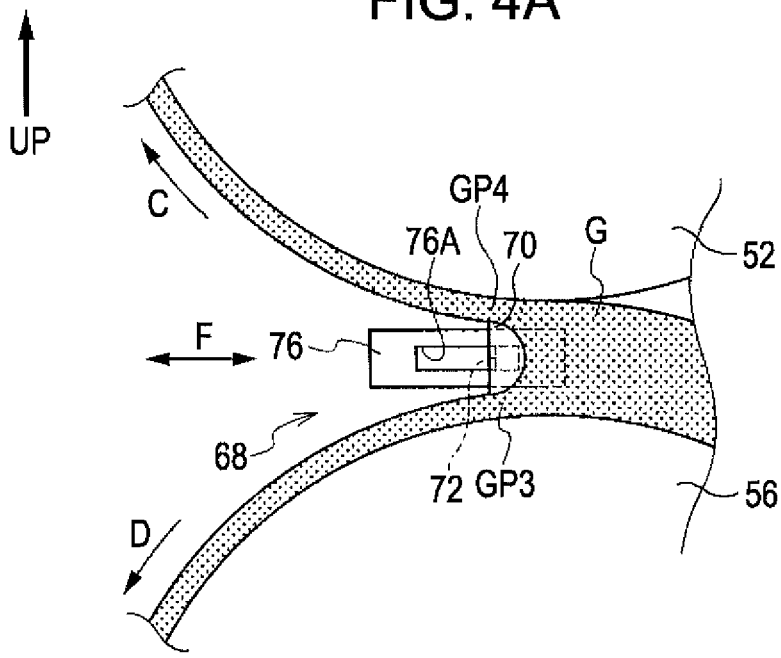
FIGS. 4A and 4B are side views of the distributing member used in the developing device of the first exemplary embodiment.
Figure 4B:
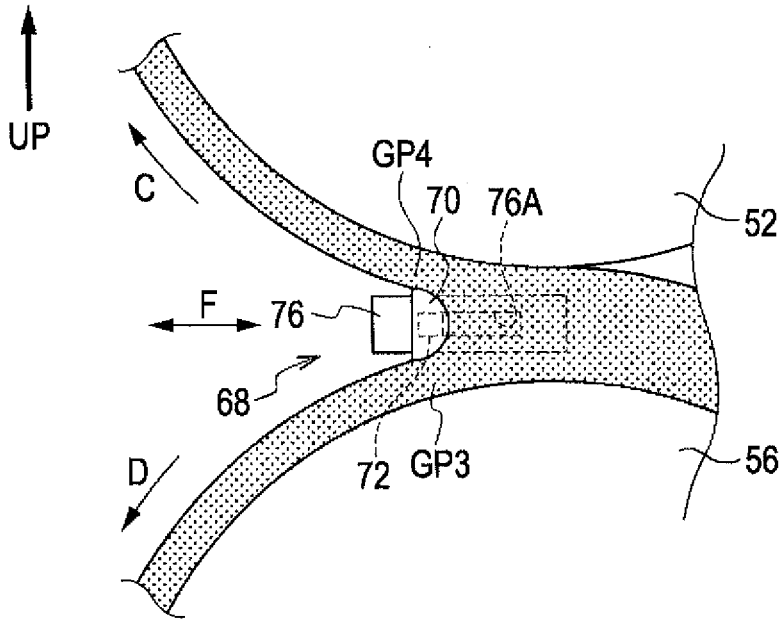

As illustrated in FIG. 3, the distributing member 68 includes a distributing portion 70 having a semicircular cross section and having a curved surface 70C that distributes the developer G (see FIG. 1) by contact therewith, and rectangular prism-shaped support portions 72 for supporting the distributing portion 70. The support portions 72 protrude from both longitudinal end faces of the distributing portion 70 and are movably supported by guide members 76 fixed to the housing 50 (see FIG. 2) so that the semicircular distributing portion 70 is movable on a straight line perpendicular to a straight line that connects the center of the first developing member and the second developing member and passes through the proximal portion 54 between the surface of the first developing member and the surface of the second developing member.

More specifically, as illustrated in FIGS. 1 and 3, the guide members 76 are each shaped like a rectangular parallelepiped, and extend in an orthogonal direction orthogonal to a straight line connecting a rotation axis 520 of the first developing roller 52 and a rotation axis 56C of the second developing roller 56 (direction of arrow F: hereinafter simply referred to as an orthogonal direction), as viewed in the direction of the rotation axis 52C of the first developing roller 52. Further, the guide members 76 have guide holes 76A extending in the orthogonal direction, and the support portions 72 of the distributing member 68 are passed through the guide holes 76A. End portions 72A of the support portions 72 protrude from the guide holes 76A, and ends of elastically deformable and coil-shaped spring members 80 that bias the distributing member 68 toward the proximal portion 54 are fixed to the protruding end portions 72A.

With this structure, the distributing member 68 is supported by the guide members 76 so as to be movable in the orthogonal direction, and is biased by the spring members 80 toward the proximal portion 54.

Operation

Next, a description will be given of a manner in which the developer G is transported in the developing device 18.

As illustrated in FIGS. 1 and 2, in the developing device 18, the developer G is supplied to the second developing roller 56 by the first agitation and transport auger 58 and the second agitation and transport auger 60. The developer G supplied to the second developing roller 56 is attracted onto the surface of the second developing sleeve 56A by the action of the pole S3 that performs pickup and trimming, and is distributed to the first developing roller 52 and the second developing roller 56 by the distributing member 68. The developer distributed to the first developing roller 52 is transported along the surface of the first developing sleeve 52A with rotation of the first developing sleeve 52A in the rotating direction C. Then, the toner on the first developing sleeve 52A is transferred onto the image carrier 12 for development near the developing pole N3. Near the pole N4 for pickoff, the developer G falls off the surface of the first developing sleeve 52A, and is returned to the reservoir 50B along the guide plate 64.

With rotation of the second developing sleeve 56A in the rotating direction D, the developer G held on the surface of the second developing sleeve 56A is transported along the surface of the second developing sleeve 56A to the pole N2 for transport, the developing pole S1, the pole N1 for transport, and the pole S2 for pickoff in this order. Near the developing pole S1, the toner on the second developing sleeve 56A is transferred onto the image carrier 12, so that the electrostatic latent image formed on the image carrier 12 is visualized. The second developing roller 56 moves in the same direction as the moving direction of the image carrier 12 at the position GP2 opposing the image carrier 12, thereby correcting the image developed by the first developing sleeve 52A and obtaining a high-quality output image. Near the pole S2 for pickoff, the developer G falls off the surface of the second developing sleeve 56A, and returns to the reservoir 50B.

As described above, the distributing member 68 is supported movably in the orthogonal direction, and is biased toward the proximal portion 54 by the spring members 80. For this reason, when the distributing member 68 distributes the developer G to the first developing roller 52 and the second developing roller 56 by being pushed by the developer G, the distributing member 68 is slightly biased. Hence, the pressure of the developer G is equal between the proximal portion 54 and an area surrounded by a gap GP3 formed between the curved surface 70C of the distributing portion 70 and the surface of the second developing roller 56 and a gap GP4 formed between the curved surface 70C and the surface of the first developing roller 52.

As described above, since the pressure of the developing agent G is equal between the proximal portion 54 and the area surrounded by the gap GP3 and the gap GP4, the ratio of the developing agent G adhering to the first developing roller 52 and the developing agent G adhering to the second developing roller 56 is properly maintained (for example, when the first developing roller 52 and the second developing roller 56 have the same peripheral velocity, the developing agent G is equally distributed to the first developing roller 52 and the second developing roller 56).

When the ratio of the developing agent G adhering to the first developing roller 52 and the developing agent G adhering to the second developing roller 56 is properly maintained, the ratio in conveyance amount per unit area between the developing agent G adhering to the first developing roller 52 and the developing agent G adhering to the second developing roller 56 is controlled constantly and properly.

Since the ratio in conveyance amount per unit area of the developing agent G adhering to the first developing roller 52 and the developing agent G adhering to the second developing roller 56 is constantly and properly controlled, the electrostatic latent image formed on the surface of the image bearing member 12 is developed evenly.

Since the electrostatic latent image formed on the surface of the image bearing member 12 is evenly developed, density unevenness of the output image is reduced.

While the exemplary embodiment of the present invention has been described above, the present invention is not limited to the exemplary embodiment, and it is obvious to those skilled in the art that other various embodiments may be adopted within the scope of the invention. For example, while the distributing portion 70 is biased by the spring members 80 in the first exemplary embodiment, it may be biased by other elastic members that are capable of elastic deformation.

Next, a description will be given of examples of a developing device and an image forming apparatus according to a second exemplary embodiment of the present invention with reference to FIG. 6. The same components as those adopted in the first exemplary embodiment are denoted by the same reference numerals, and descriptions thereof are omitted.

Figure 6:
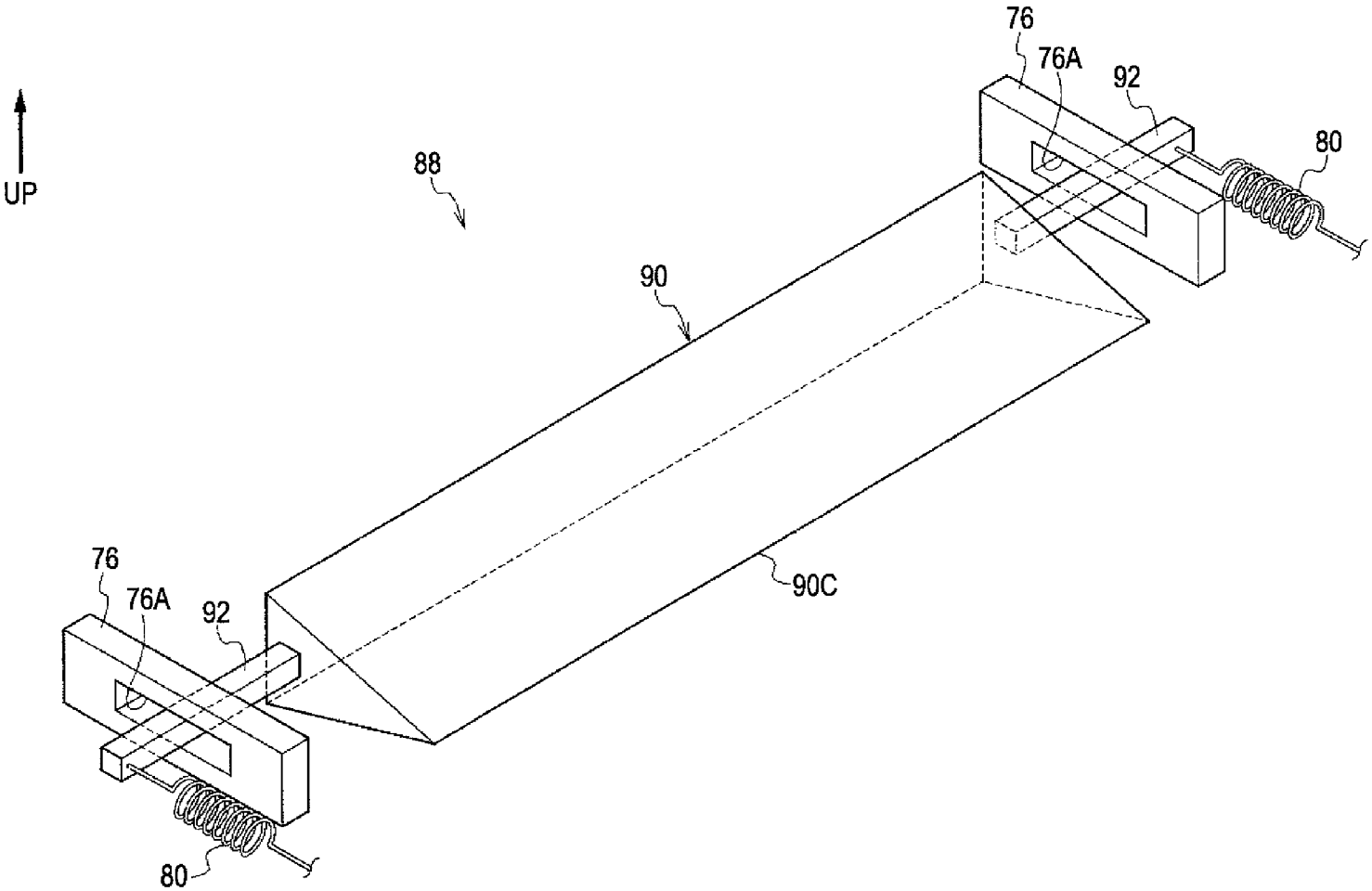
FIG. 6 is a perspective view illustrating a distributing member and its surroundings used in a developing device according to a second exemplary embodiment of the present invention.

As illustrated in FIG. 6, a distributing member 88 according to the second exemplary embodiment includes a distributing portion 90 having a triangular cross section and support portions 92 that support the distributing portion 90. A vertex 90C of the distributing portion 90 distributes developer G by contact therewith. The support portions 92 protrude from both longitudinal end faces of the distributing portion 90, and are movably supported by guide members 76 fixed to a housing. In this way, the developer G may be efficiently distributed by the vertex 90C.

Next, a description will be given of examples of a developing device, an assembly, and an image forming apparatus according to a third exemplary embodiment of the present invention with reference to FIG. 7. The same components as those adopted in the first exemplary embodiment are denoted by the same reference numerals, and descriptions thereof are omitted.

Figure 7:
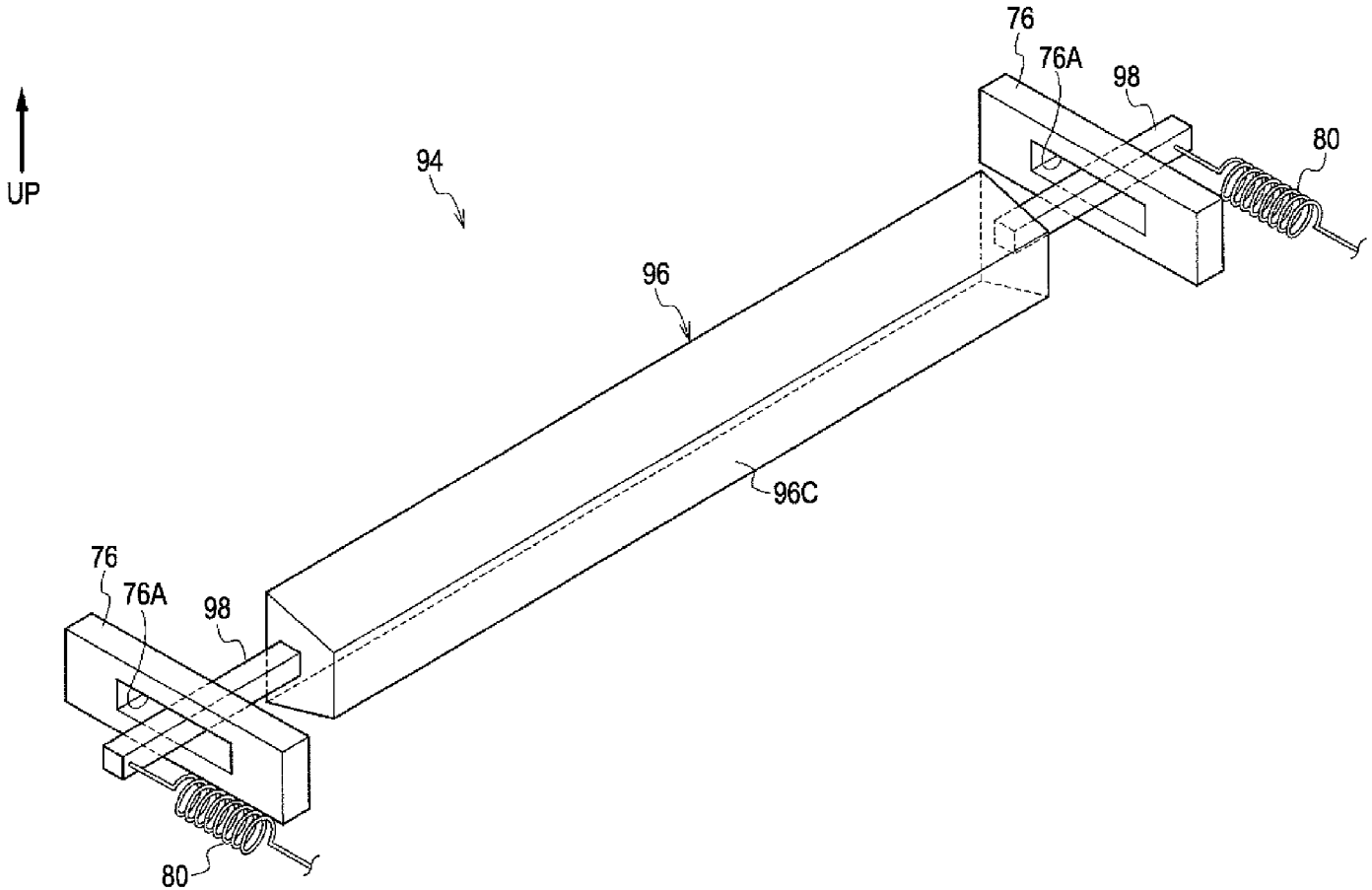
FIG. 7 is a perspective view illustrating a distributing member and its surroundings used in a developing device according to a third exemplary embodiment of the present invention.

As illustrated in FIG. 7, a distributing member 94 according to the third exemplary embodiment includes a distributing portion 96 having a trapezoidal cross section and support portions 98 that support the distributing portion 96. A top surface 96C of the distributing portion 96 distributes developer G by contact with the developer G. The support portions 98 protrude from both longitudinal end faces of the distributing portion 96, and are movably supported by guide members 76 fixed to a housing. By thus providing the distributing portion 96 with a trapezoidal cross section, rigidity of the distributing portion 96 may be increased.

While the exemplary embodiments of the present invention has been described in detail above, the present invention is not limited to these exemplary embodiments, and it is obvious to those skilled in the art that other various embodiments may be adopted within the scope of the invention. For example, while the cross section of the distributing portion 96 is trapezoidal in the third exemplary embodiment, it may have other shapes instead of the trapezoidal shape.

What is claimed is:

1. A developing device comprising: a first developing member that opposes a surface of a rotating image carrier and rotates in a manner such that a moving direction of a portion opposing the image carrier is opposite a moving direction of the image carrier; a second developing member that is provided on a downstream side of the first developing member in a rotating direction of the image carrier, opposes the surface of the image carrier, and rotates in a manner such that a moving direction of a portion opposing the image carrier is the same as the moving direction of the image carrier; a distributing member that is supported movably relative to a proximal portion between the first developing member and the second developing member where the first developing member is closest to the second developing member, the distributing member being provided on a downstream side of the proximal portion in a rotating direction of the first developing member, and distributing, to the first developing member and the second distributing member, developer lying between a surface of the first developing member and a surface of the second developing member by contact with the developer; and a biasing member that biases the distributing member upstream in the rotating direction of the first developing member, wherein the biasing member is an elastically deformable spring member that biases the distributing member in an orthogonal direction orthogonal to a line connecting a rotation axis of the first developing member and a rotation axis of the second developing member, as viewed in an axial direction of the first developing member.

2. The developing device according to claim 1, wherein the biasing member biases the distributing member towards the proximal portion.

3. The developing device according to claim 1, further comprising: a guide member that guides the distributing member in the orthogonal direction.

4. An assembly comprising:

developing device according to claim 1; and an image carrier having a surface on which an electrostatic latent image is formed, the electrostatic latent image being visualized as a toner image by the developing device, wherein the assembly is removably assembled in a main body.

5. An image forming apparatus comprising:

the assembly according to claim 4; and a transfer member that transfers the toner image formed on the surface of the image carrier in the assembly onto a transfer material.

6. An image forming apparatus comprising:

developing device according to claim 1;

an image carrier having a surface on which an electrostatic latent image is formed, the electrostatic latent image being visualized as a toner image by the developing device; and a transfer member that transfers the toner image formed on the surface of the image carrier onto a transfer material.

* * * * *